US011324374B2

(12) United States Patent
Jung et al.

(10) Patent No.: US 11,324,374 B2
(45) **Date of Patent: *May 10, 2022**

(54) ROBOT CLEANER AND CONTROL METHOD THEREOF

(71) Applicant: Samsung Electronics Co., Ltd., Suwon-si (KR)

(72) Inventors: Jae Young Jung, Suwon-si (KR); Sahng Jin Lee, Seongnam-si (KR); Hyun Soo Jung, Seongnam-si (KR); Dong Won Kim, Hwaseong-si (KR); Dong Hoon Lee, Gwang-ju (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 197 days.

This patent is subject to a terminal disclaimer.

(21) Appl. No.: 16/506,003

(22) Filed: Jul. 9, 2019

(65) Prior Publication Data

US 2019/0328197 A1 Oct. 31, 2019

Related U.S. Application Data

(62) Division of application No. 14/166,166, filed on Jan. 28, 2014, now Pat. No. 10,390,672.

(51) Int. Cl.
*A47L 11/24* (2006.01)
*A47L 11/40* (2006.01)

(52) U.S. Cl.
CPC ..... *A47L 11/24* (2013.01); *A47L 11/4002* (2013.01); *A47L 11/4011* (2013.01);
(Continued)

(58) Field of Classification Search
CPC .. A47L 11/24; A47L 11/4002; A47L 11/4011; A47L 11/4041; A47L 11/4088; A47L 2201/00
See application file for complete search history.

(56) References Cited

U.S. PATENT DOCUMENTS 5,424,939 A 6/1995 Kweon
5,519,914 A 5/1996 Egan
(Continued)

FOREIGN PATENT DOCUMENTS

CN 102078169 6/2011
CN 202341952 7/2012
(Continued)

OTHER PUBLICATIONS

Korean Office Action dated Jul. 24, 2019 in Korean Patent Application No. 10-2013-0011520.
(Continued)

*Primary Examiner* — Joseph L. Perrin
*Assistant Examiner* — Irina Graf
(74) *Attorney, Agent, or Firm* — Staas & Halsey LLP

(57) ABSTRACT

A robot cleaner may include a main body; a traveling assembly moving the main body; a cleaning tool assembly installed in the lower part of the main body, and contacting a floor to clean the floor; a water-feeding unit supplying water to the cleaning tool assembly; and a capacitance measurer contacting the cleaning tool assembly, and measuring capacitance of the cleaning tool assembly in order to calculate an amount of water of the cleaning tool assembly. Accordingly, by measuring an amount of water of a cleaning tool installed in a robot cleaner based on capacitance, it is possible to accurately measure an amount of water absorbed in a cleaning tool.

11 Claims, 17 Drawing Sheets

(52) U.S. Cl.
CPC ..... *A47L 11/4041* (2013.01); *A47L 11/4088* (2013.01); *A47L 2201/00* (2013.01)

(56) References Cited

U.S. PATENT DOCUMENTS

| | | | |
|---|---|---|---|
| 5,959,423 | A | 9/1999 | Nakanishi |
| 6,433,244 | B1 | 8/2002 | Roe |
| 6,459,955 | B1 | 10/2002 | Bartsch |
| 6,571,421 | B1 | 6/2003 | Sham |
| 6,756,793 | B2 | 6/2004 | Hirono |
| 2002/0000813 | A1 | 1/2002 | Hirono et al. |
| 2002/0042965 | A1 | 4/2002 | Salem |
| 2002/0174506 | A1 | 11/2002 | Wallach |
| 2003/0097727 | A1 | 5/2003 | Keller |
| 2006/0190146 | A1 | 8/2006 | Morse |
| 2008/0206092 | A1 | 8/2008 | Crapser |
| 2011/0202175 | A1 | 8/2011 | Romanov |
| 2012/0036659 | A1 | 2/2012 | Ziegler |
| 2012/0103078 | A1 | 5/2012 | Reimann |
| 2012/0304742 | A1 | 12/2012 | Cummins |
| 2014/0259478 | A1 | 9/2014 | Conrad |

FOREIGN PATENT DOCUMENTS

| | | | | |
|---|---|---|---|---|
| DE | 102008021100 | A1 | 10/2009 | |
| DE | 102011003158 | | 7/2012 | |
| DE | 102011050358 | A1 | 11/2012 | |
| EP | 1762165 | | 3/2007 | |
| WO | WO-2008061974 | A2 * | 5/2008 | ..... A47L 11/185 |

OTHER PUBLICATIONS

Korean Notice of Allowance dated Sep. 20, 2019 in Korean Patent Application No. 10-2013-0011520.
Extended European Search Report dated Feb. 22, 2018 in European Patent Application No. 13197482.6.
Korean Office Action dated Feb. 26, 2019 in Korean Patent Application No. 10-2013-0011520.
Roveti D. K. "Choosing a Humidity Sensor" Sensors Magazine, ISSN: 0746-9462, vol. 18 No. 7, Jul. 2001.
U.S. Restriction Requirement dated Sep. 30, 2016 in U.S. Appl. No. 14/166,166.
U.S. Office Action dated Jan. 6, 2017 in U.S. Appl. No. 14/166,166.
U.S. Office Action dated Jun. 2, 2017 in U.S. Appl. No. 14/166,166.
U.S. Office Action dated Nov. 2, 2017 in U.S. Appl. No. 14/166,166.
U.S. Office Action dated May 2, 2018 in U.S. Appl. No. 14/166,166.
U.S. Office Action dated Aug. 28, 2018 in U.S. Appl. No. 14/166,166.
U.S. Office Action dated Jan. 25, 2019 in U.S. Appl. No. 14/166,166.
U.S. Notice of Allowance dated Apr. 11, 2019 in U.S. Appl. No. 14/166,166.
U.S. Appl. No. 14/166,166, filed Jan. 28, 2014, Jae Young Jung, et al., Samsung Electronics Co., Ltd.

* cited by examiner (a)

(b)

ROBOT CLEANER AND CONTROL METHOD THEREOF

CROSS-REFERENCE TO RELATED APPLICATIONS

This application is a divisional application of U.S. patent application Ser. No. 14/166,166, filed on Jan. 28, 2014, which claims the priority benefit of Korean Patent Application No. 10-2013-0011520, filed on Jan. 31, 2013 in the Korean Intellectual Property Office, the disclosures of which are incorporated herein by reference.

BACKGROUND

1. Field

Embodiments relate to a robot cleaner for improving efficiency of wet cleaning, and a control method thereof.

2. Description of the Related Art

In general, a robot cleaner automatically cleans an area to be cleaned by sucking up foreign substances such as dust from a floor while autonomously traveling about the cleaning area without user manipulation.

The robot cleaner cleans a floor using a cleaning tool while autonomously traveling about a cleaning area. During cleaning, the robot cleaner senses obstacles or walls located in an area to be cleaned through various sensors, and controls a cleaning path or a cleaning operation based on the sensed results.

Most of robot cleaners developed so far clean a floor using a dry-type cleaning method of sucking up dust from a floor.

However, when a robot cleaner cleans a floor according to the dry-type cleaning method, some foreign substances may remain on a floor even after cleaning is completed since the robot cleaner cannot suck up foreign substances stuck on the floor or being larger than a specific size.

In order to overcome the problem, a robot cleaner for wet cleaning in which a pad is installed in the lower part of a main body to wipe a floor with water has been developed.

However, when a user cleans a floor using a robot cleaner for wet cleaning, the user must check an amount of water of a pad and add water to the pad if necessary, which causes the user's inconvenience.

SUMMARY

In an aspect of one or more embodiments, there is provided a robot cleaner for measuring an amount of water of a cleaning tool based on capacitance, and a control method thereof.

In an aspect of one or more embodiments, there is provided a robot cleaner for automatically adding an appropriate amount of water to a cleaning tool, and a control method thereof.

In an aspect of one or more embodiments, there is provided a robot cleaner which includes: a main body; a traveling assembly moving the main body; a cleaning tool assembly installed in the lower part of the main body, and contacting a floor to clean the floor; a water-feeding unit supplying water to the cleaning tool assembly; and a capacitance measurer contacting the cleaning tool assembly, and measuring capacitance of the cleaning tool assembly in order to calculate an amount of water of the cleaning tool assembly.

In an aspect of one or more embodiments, there is provided a robot cleaner which includes: a cleaning tool assembly cleaning a floor with water; a capacitance measurer measuring capacitance of the cleaning tool assembly; and a controller calculating an amount of water of the cleaning tool assembly based on the measured capacitance, and controlling cleaning of the cleaning tool assembly based on the calculated amount of water.

In an aspect of one or more embodiments, there is provided a control method of a cleaning robot, the cleaning robot including a main body, a traveling assembly traveling about a floor while moving the main body, and a cleaning tool assembly rotatably coupled to the main body and cleaning the floor with water, the control method includes: if a cleaning command is received, measuring capacitance of the cleaning tool assembly using a capacitance; calculating an amount of water of the cleaning tool assembly based on the measured capacitance; and controlling traveling and cleaning of the cleaning tool assembly based on the calculated amount of water.

According to an aspect, by measuring an amount of water of a cleaning tool installed in a robot cleaner based on capacitance, it is possible to accurately measure an amount of water absorbed in a cleaning tool.

By designing the robot cleaner such that no air gap is formed between the housing of a capacitance measurer and capacitance sensors and such that the capacitance measurer is buried in a pad of a cleaning tool assembly in order to prevent the capacitor sensors from being influenced by the temperature and humidity of air, it is possible to accurately measure an amount of water absorbed in the pad of the cleaning tool assembly.

Also, since the capacitance sensors are used as measurers for measuring an amount of water, it is possible to reduce a manufacturing cost of the robot cleaner.

In addition, by automatically adding an appropriate amount of water to the cleaning tool based on a measured amount of water, it is possible to uniformly maintain the efficiency of cleaning and consequently improve cleaning performance, resulting in improvement of a user's satisfaction.

BRIEF DESCRIPTION OF THE DRAWINGS

These and/or other aspects of embodiments will become apparent and more readily appreciated from the following description of embodiments, taken in conjunction with the accompanying drawings of which.

DETAILED DESCRIPTION

Figure 1:
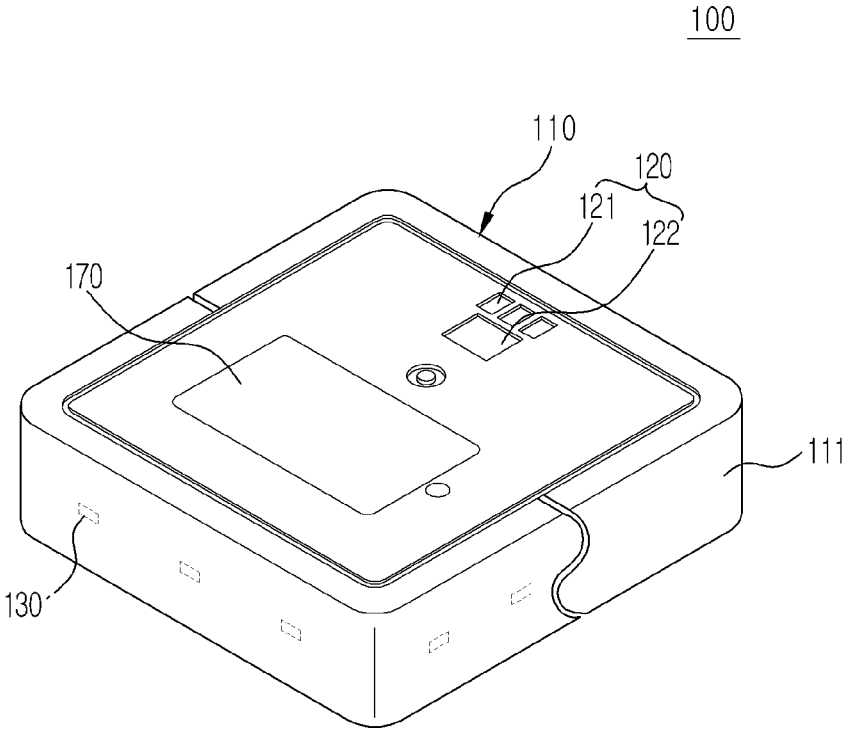
FIG. 1 is a perspective view of a robot cleaner according to an exemplary embodiment.

Reference will now be made in detail to embodiments, examples of which are illustrated in the accompanying drawings, wherein like reference numerals refer to like elements throughout.

FIGS. 1 to 4 are views illustrating a robot cleaner 100 according to an exemplary embodiment.

Figure 2:
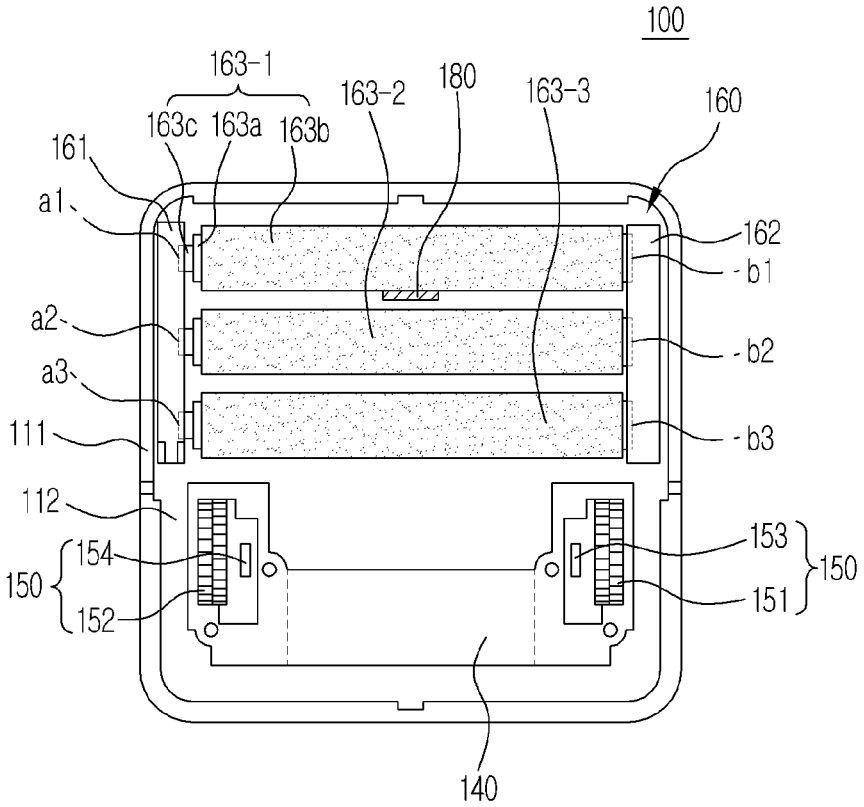
FIG. 2 is a bottom view of a robot cleaner according to an exemplary embodiment.
Figure 3A:
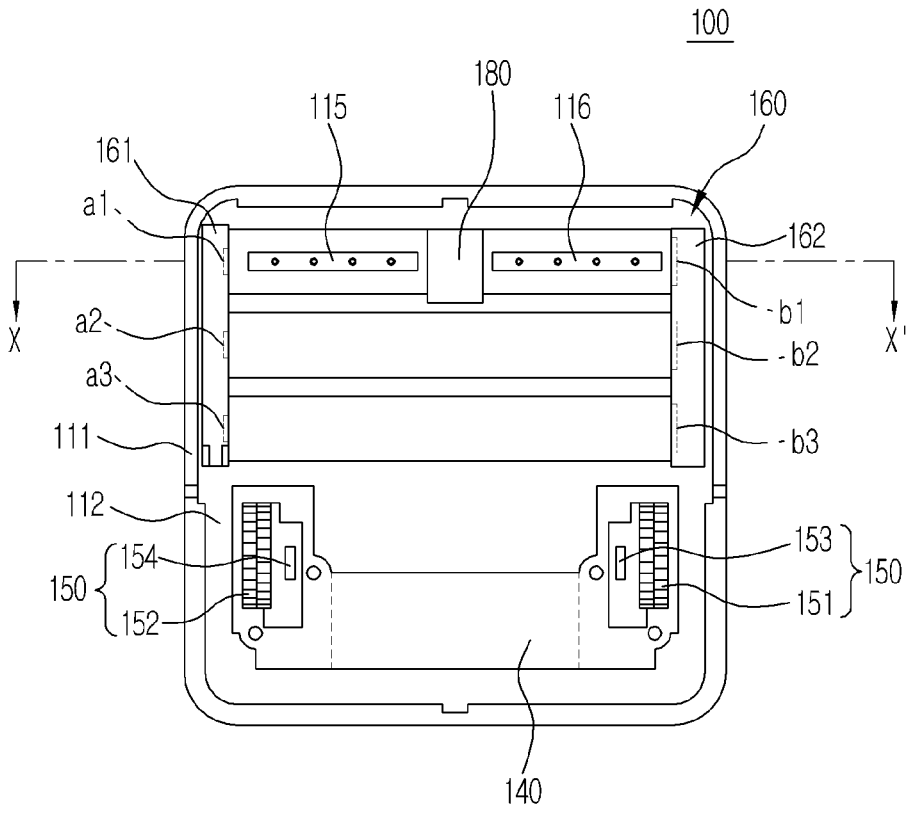
FIG. 3A is a bottom view of a robot cleaner when a cleaning tool assembly has been separated from a main body.
Figure 3B:
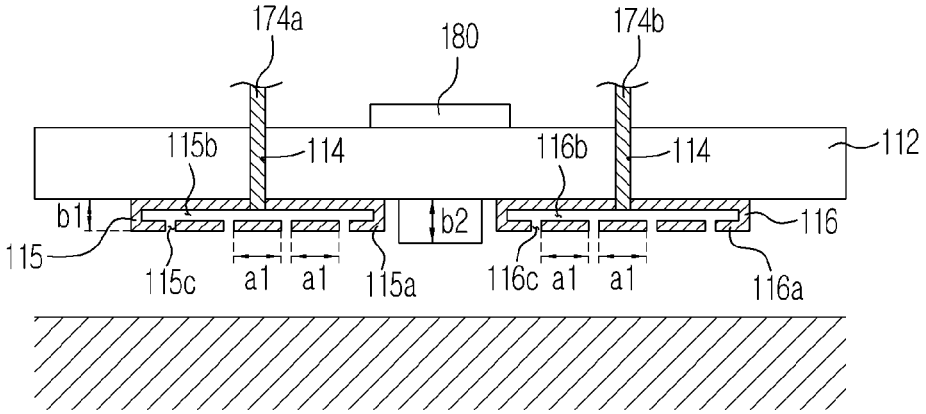
FIG. 3B is a cross-sectional view of the robot cleaner of FIG. 3A, cut along an x-x' line.
Figure 4:
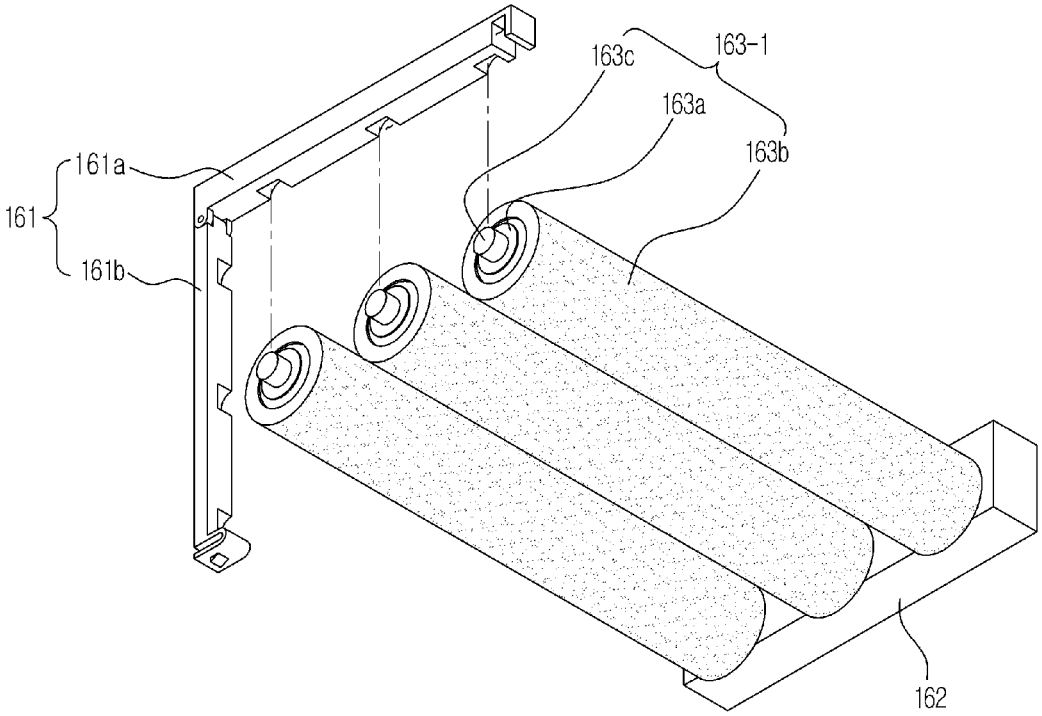
FIG. 4 is an exploded perspective view of a cleaning tool assembly of a robot cleaner, according to an exemplary embodiment.

FIG. 1 is a perspective view of the robot cleaner 100, FIG. 2 is a bottom view of the robot cleaner 100, FIG. 3A is a bottom view of the robot cleaner 100 when a cleaning tool assembly 160 has been separated from a main body 110, FIG. 3B is a cross-sectional view of the robot cleaner 100, cut along an x-x' line, and FIG. 4 is an exploded perspective view of the cleaning tool assembly 160 of the robot cleaner 100.

Referring to FIG. 1, the robot cleaner 100 includes the main body 110 constructing an external appearance of the robot cleaner 100, a user interface 120 mounted on the upper part of the main body 110 to receive driving information, schedule information, etc. and display operation information, and one or more obstacle detectors 130 for detecting obstacles in an area to be cleaned.

The user interface 120 includes an input unit 121 for receiving schedule information, driving information, etc. and a display unit 122 for displaying schedule information, a battery level, a water level of a water tank, a driving mode, etc. The driving mode includes a cleaning mode, a standby mode, a docking mode, etc.

The obstacle detectors 130 may be distance sensors for measuring a distance between the robot cleaner 100 and an obstacle, as well as detecting existence/absence of an obstacle. The obstacle detectors 130 may be installed in the front, left, and right parts of the main body 110 to detect obstacles located in the front, left, and right directions from the robot cleaner 100 and output obstacle detection signals.

As illustrated in FIG. 2, the main body 110 of the robot cleaner 100 includes a bumper 111 disposed to surround the front and side parts of the main body 110 to cushion the impact when the robot cleaner 100 collides with an obstacle, and a frame 112 in which a power supply 140, a traveling assembly 150, a cleaning tool assembly 160, a driving module 190 (see FIG. 11), etc. are installed. Another bumper may be disposed to surround the rear part of the main body 110.

Also, the main body 110 of the robot cleaner 100 may further include an inserting hole 113 (see FIG. 5A) formed at a location corresponding to the cleaning tool assembly 160 in the frame 112, one or more water-feeding holes 114 formed around the inserting hole 113 to add water to the cleaning tool assembly 160, and first and second spraying members 115 and 116 disposed on the lower surface of the frame 112 and connected to the water-feeding holes 114 to spray water supplied through first and second channels 174*a* and 174*b* to the outside.

The inserting hole 113 is a hole which a capacitance measurer 180 is inserted into and installed in.

The capacitance measurer 180 may be installed in an arbitrary location, other than in the inserting hole 113, as long as it can contact a first drum-type pad member 163-1.

The water-feeding holes 114 are holes which the first and second channels 174*a* and 174*b* are inserted into and connected to.

The first and second spraying members 115 and 116 add water to the first drum-type pad member 163-1. The first and second spraying members 115 and 116 will be described in more detail with reference to FIGS. 3A and 3B, below.

As described above, FIG. 3A is a bottom view illustrating the robot cleaner 100 when the cleaning tool assembly 160 has been separated from the main body 110, and FIG. 3B is a cross-sectional view illustrating the robot cleaner 100 of FIG. 3A, cut along an x-x' line.

As illustrated in FIGS. 3A and 3B, the first and second spraying members 115 and 116 are disposed at locations corresponding to the water-feeding holes 114 on the lower part of the frame 112, and the capacitance measurer 180 is inserted into the inserting hole 113 (see FIG. 5A) formed in the lower part of the frame 112.

The first and second spraying members 115 and 116 and the capacitance measurer 180 may be arranged at a location corresponding to a pad member for wet cleaning. That is, the first and second spraying members 115 and 116 and the capacitance measurer 180 may be arranged over the first drum-type pad member 163-1.

As illustrated in FIG. 3B, the first spraying member 115 includes a main body 115*a* coupled to the frame 112, a main channel 115*b* formed in the main body 115*a* to receive water from the first channel 174*a* through the water-feeding hole 114, and a plurality of spraying holes 115*c* formed in the main body 115*a* and connected to the main channel 115*b* to discharge water contained in the main channel 115*b* to the outside.

The plurality of spraying holes 115*c* are formed at regular intervals of a1.

The second spraying member 116 includes a main body 116*a* coupled to the frame 112, a main channel 116*b* formed in the main body 116*a* to receive water from the second channel 174*b* through the water-feeding hole 114, and a plurality of spraying holes 116*c* formed in the main body 116*a* and connected to the main channel 116*b* to discharge water contained in the main channel 116*b* to the outside.

Likewise, the plurality of spraying holes 116*c* are formed at regular intervals of a1.

The first and second spraying members 115 and 116 are protruded toward a floor from the frame 112, and a length b1 by which the first and second spraying members 115 and 116 are protruded is shorter than a length b2 by which the capacitance measurer 180 is protruded from the frame 112 toward the floor.

That is, the capacitance measurer 180 inserted into the inserting hole 113 is further protruded toward the floor than the first and second spraying members 115 and 116.

However, a single water-feeding hole may be formed in the frame 112. In this case, a channel of a water-feeding unit (water-feeder) 170 (see FIG. 6) may be inserted into and connected to the water-feeding hole, and the water-feeding hole may receive water through the channel, and then spray the water to the outside through a plurality of spraying holes.

Referring again to FIG. 2, the robot cleaner 100 includes the power supply 140 for supplying driving power to individual components, the traveling assembly 150 disposed in the rear, lower part of the main body 110 to move the main body 110, the cleaning tool assembly 160 disposed in the front, lower part of the main body 110 to wipe off foreign substances such as dust scattered on a floor with water, the water-feeding unit 170 (see FIG. 6) for adding water to the cleaning tool assembly 160, and the capacitance measurer 180 for measuring capacitance of the cleaning tool assembly 160. The front and rear parts of the main body 110 have been determined based on a traveling direction of the main body 110 upon cleaning.

The robot cleaner 100 further includes the driving module 190 for driving the traveling assembly 150, the cleaning tool assembly 160, the water-feeding unit 170, and the capacitance measurer 180 using power supplied from the power supply 140. The driving module 190 will be described in detail later.

The power supply 140 includes a battery electrically connected to the components 120, 130, 140, 150, 160, and 170 installed in the main body 110 and supplying driving power to the components 120, 130, 140, 150, 160, and 170.

The battery is a rechargeable, secondary battery, and electrically connects to a recharging base (not shown) through two recharging terminals (not shown) to receive power from the recharging base and perform recharging.

The traveling assembly 150 includes a pair of wheels 151 and 152 rotatably disposed in the left and right edges of the rear part of the main body 110 to move back and forth and rotate the main body 110, and a pair of wheel motors 153 and 154 for applying a driving force to the respective wheels 151 and 152. The pair of wheels 151 and 152 are positioned to be symmetrical to each other.

The cleaning tool assembly 160 is disposed in the front, lower part of the main body 110, and wipes off dust scattered on a floor below the main body 110 with water. The cleaning tool assembly 160 will be described in detail with reference to FIG. 4.

Referring to FIG. 4, the cleaning tool assembly 160 includes first and second jig members 161 and 162 disposed in the front, left and right sides of the frame 112 of the main body 110, and one or more pad members 163-1, 163-2, and 163-3 (see FIG. 2) positioned between the first and second jig members 161 and 162 and removably coupled to the first and second jig members 161 and 162. Each of the pad members 163-1, 163-2, and 163-3 is a rotatable drum-type pad member 163.

However, each of the pad members 163-1, 163-2, and 163-3 may be a fixed-type pad member. If a plurality of pad members are provided, a foremost pad member of the pad members in the traveling direction of the robot cleaner 100 may be implemented as a drum-type pad member, and the remaining pad members may be implemented as fixed-type pad members.

The drum-type pad members 163-1, 163-2, and 163-3 may be implemented as one or more units, and in this embodiment, the robot cleaner 100 includes three drum-type pad members 163-1, 163-2, and 163-3.

The first jig member 161 includes a fixed member 161*a* fixed at a first side of the frame 112, and a separable member 161*b* removably coupled to the fixed member 161*a*.

Each of the fixed member 161*a* and the separable member 161*b* includes a plurality of grooves, and when the fixed member 161 is coupled to the separable member 161*b*, the grooves of the fixed member 161*a* and the separable member 161*b* form a plurality of first locking grooves a1, a2, and a3.

That is, the first jig member 161 includes a plurality of first locking grooves a1, a2, and a3, and first ends of the drum-type pad members 163-1, 163-2, and 163-3 are coupled to the first locking grooves a1, a2, and a3.

The separable member 161*b* is used to separate the drum-type pad members 163-1, 163-2, and 163-3 coupled between the first and second jig members 161 and 162 from the main body 110. When the separable member 161*b* is separated from the fixed member 161*a*, the first, second and third drum-type pad members 163-1, 163-2, and 163-3 are separated from the main body 110.

The second jig member 162 is fixed to a second side of the frame 112, which is opposite to the first side of the frame 112 to which the first jig member 161 is fixed.

The second jig member 162 includes a plurality of second locking grooves b1, b2, and b3, and gear members 164 (see FIG. 5A) are disposed in the plurality of second locking grooves b1, b2, and b3.

Second ends of the drum-type pad members 163-1, 163-2, and 163-3 are coupled to the second locking grooves b1, b2, and b3, and the drum-type pad members 163-1, 163-2, and 163-3 coupled to the second locking grooves b1, b2, and b3 rotate by driving forces of the gear members 164.

The drum-type pad members 163-1, 163-2, and 163-3 are coupled between the first and second jig members 161 and 162 in such a manner that protrusions of both ends of each of the drum-type pad members 163-1, 163-2, and 163-3 are inserted into and coupled to the corresponding ones of the first locking grooves a1, a2, and a3 and the second locking grooves b1, b2, and b3.

That is, the first drum-type pad member 163-1 is rotatably coupled between the first and second locking grooves a1 and b1, the second drum-type pad member 163-2 is rotatably coupled between the first and second locking grooves a2 and b2, and the third drum-type pad member 163-3 is rotatably coupled between the first and second locking grooves a3 and b3.

Each of the drum-type pad members 163-1, 163-2, and 163-3 includes a drum 163*a*, a pad 163*b* detachably attached on the external surface of the drum 163*a* and contacting a floor to wipe the floor, and protrusions 163*c* formed at both ends of the drum 163*a* to be protruded outward from both ends of the drum 163*a*, and respectively inserted into and coupled to the first locking groove of the first jig member 161 and the second locking groove of the second jig member 162.

The drum-type pad members 163-1, 163-2, and 163-3 are arranged in a line with respect to the traveling direction of the main body 110, and accordingly, the second and third drum-type pad members 163-2 and 163-3 sequentially travel about an area about which the first drum-type pad member 163-1 has traveled.

That is, the robot cleaner 100 may repeatedly clean an area using the drum-type pad members 163-1, 163-2, and 163-3.

The pad 163*b* may be detached from the drum 163*a* and replaced with another pad.

The pad 163*b* is protruded outward from the main body 110 in order to ensure a sufficient friction force with respect to a floor. The pad 163*b* is further protruded toward a floor than the two wheels 151 and 152.

Also, the drum-type pad members 163-1, 163-2, and 163-3 may rotate in a clockwise direction or in a counter-clockwise direction.

Also, the drum-type pad members 163-1, 163-2, and 163-3 may connect to different gear members, respectively, and accordingly, the drum-type pad members 163-1, 163-2, and 163-3 may rotate in different rotation directions with different rotation speeds.

Figure 5A:
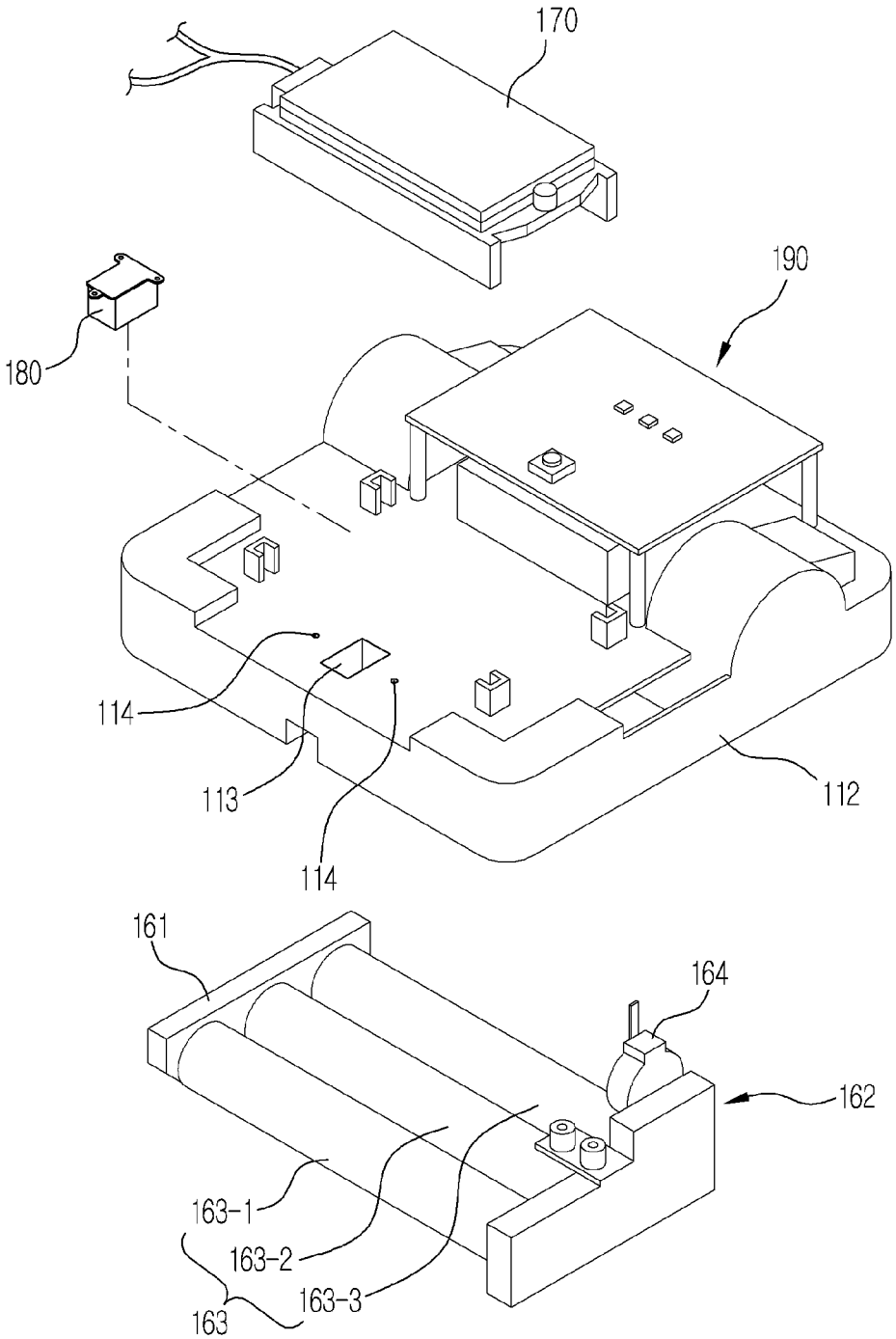
FIG. 5A is an exploded perspective view illustrating a main body and a capacitance measurer of a robot cleaner, according to an exemplary embodiment.
Figure 5B:
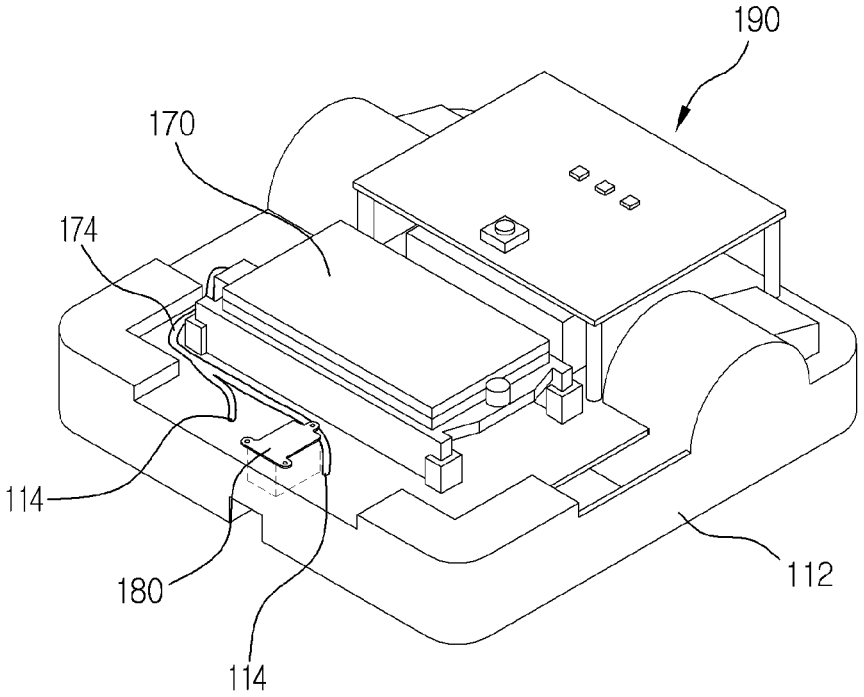
FIG. 5B is a perspective view illustrating a coupled state of a main body and a capacitance measurer of a robot cleaner, according to an exemplary embodiment.

FIG. 5A is an exploded perspective view illustrating the main body 110 and the capacitance measurer 180 of the robot cleaner 100, according to an exemplary embodiment, and FIG. 5B is a perspective view illustrating a coupled state of the main body 110 and the capacitance measurer 180 of the robot cleaner 100, according to an exemplary embodiment.

As illustrated in FIGS. 5A and 5B, the cleaning tool assembly 160 (see FIG. 2) is disposed below the frame 112, whereas the water-feeding unit 170 is disposed above the frame 112. The water-feeding unit 170 adds water to at least one drum-type pad member of the first, second, and third drum-type pad members 163-1, 163-2, and 163-3 disposed below the frame 112.

For example, if the water-feeding unit 170 supplies water only to the first drum-type pad member 163-1, the first drum-type pad member 163-1 which is the foremost pad member in the traveling direction of the robot cleaner 100 has a wet pad in which the supplied water is absorbed, and the second and third drum-type pad members 163-2 and 163-3 have dry pads. Accordingly, the second and third drum-type pad members 163-2 and 163-3 wipe off water remaining on an area cleaned with water by the first drum-type pad member 163-1.

In this embodiment, it is assumed that the water-feeding unit 170 supplies water only to the first drum-type pad member 163-1.

Figure 6:
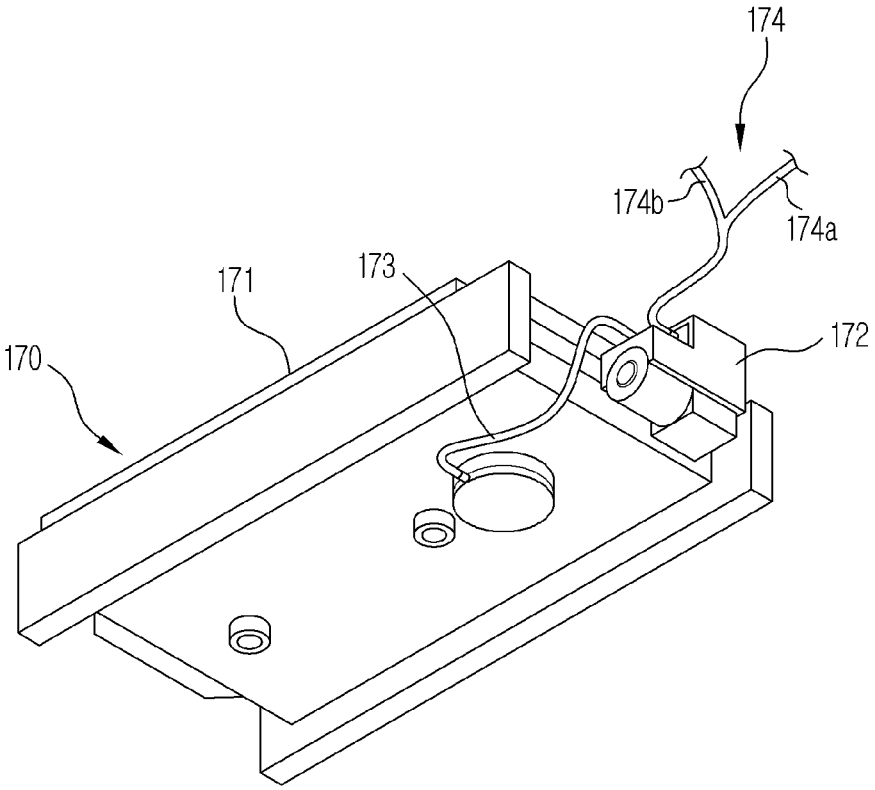
FIG. 6 is a perspective view of a water-feeding unit of a robot cleaner, according to an exemplary embodiment.

FIG. 6 is a perspective view illustrating the water-feeding unit 170 of the robot cleaner 100, according to an exemplary embodiment.

Referring to FIG. 6, the water-feeding unit 170 supplies water to the first drum-type pad member 163-1.

The water-feeding unit 170 includes a water tank 171, a pump 172, and channel members 173 and 174.

The water tank 171 is mounted on the frame 112, stores water, and discharges water to the outside during cleaning.

The water tank 171 includes an inlet (not shown) for receiving water and an outlet (not shown) for discharging water to the outside during cleaning.

The pump 172 is positioned at one side of the water tank 171, pumps water stored in the water tank 171, and supplies the pumped water to the first drum-type pad member 163-1.

The pump 172 includes an inlet (not shown) for receiving water from the water tank 171, and an outlet (not shown) for supplying water to the first drum-type pad member 163-1 (see FIG. 4).

A first channel member 173 is connected between the outlet of the water tank 171 and the inlet of the pump 172, and the outlet of the pump 172 is connected to a second channel member 174.

That is, the pump 172 receives water from the water tank 171 through the first channel member 173, pumps the water, and supplies the pumped water to the first drum-type pad member 163-1 through the second channel member 174.

The second channel member 174 includes first and second channels 174*a* and 174*b*, and the first and second channels 174*a* and 174*b* are inserted into the water-feeding holes 114 (see FIG. 3B).

Also, the first and second channels 174*a* and 174*b* may extend to a pad of the cleaning tool assembly 160 (see FIG. 2) without installing the first and second spraying members 115 and 116 (see FIG. 3A).

The water-feeding unit 170 may further include a water level measurer 175 (see FIG. 11) for measuring an amount of water stored in the water tank 171.

The capacitance measurer 180 (FIG. 7A) measures capacitance of the first drum-type pad member 163-1 in order to measure an amount of water of the first drum-type pad member 163-1. The capacitance measurer 180 will be described in detail with reference to FIGS. 7A and 7B, below.

Figure 7A:
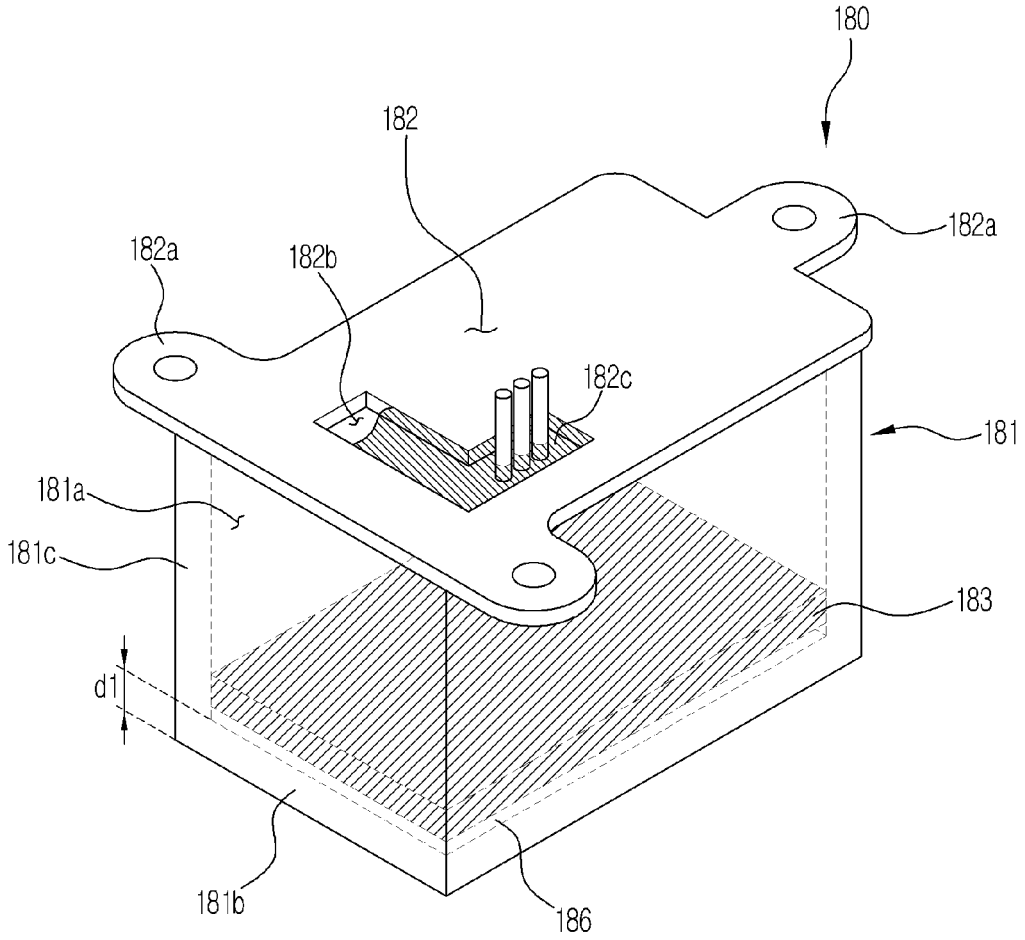
FIG. 7A is a perspective view of a capacitance measurer installed in a robot cleaner, according to an exemplary embodiment.
Figure 7B:
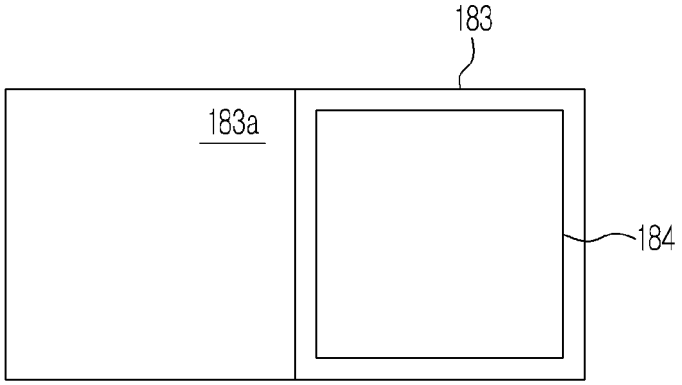
FIG. 7B, (a) and (b), illustrates a printed circuit board (PCB) substrate of the capacitance measurer installed in the robot cleaner, according to an exemplary embodiment.
Figure 7B:
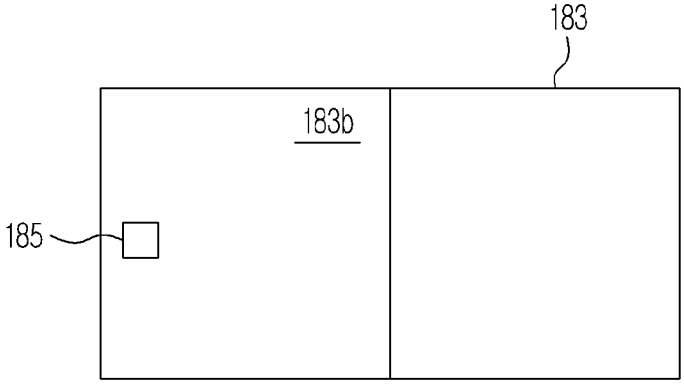

FIG. 7A is a perspective view illustrating the capacitance measurer 180 installed in the robot cleaner 100, according to an exemplary embodiment, and FIG. 7B illustrates a PCB substrate 183 of the capacitance measurer 180 installed in the robot cleaner 100, according to an exemplary embodiment.

Referring to FIG. 7A, the capacitance measurer 180 includes a housing 181 having an opening and a container 181*a*, a cover 182 covering the opening of the housing 181, the PCB substrate 183 disposed in the container 181*a* of the housing 181, and a first sensor 184 disposed on the lower surface of the PCB substrate 183 to measure capacitance in order to measure an amount of water of the cleaning tool assembly 160 (see FIG. 2).

Hereinafter, the bottom of the housing 181 is referred to as a first side 181*b*, and the lateral sides of the housing 181 are referred to as second sides 181*c*, wherein the inner surface of the first side 181*b* contacts the PCB substrate 183 and the outer surface of the first side 181*b* contacts the cleaning tool assembly 160.

The cover 182 is disposed to contact the edges of the second sides 181*c* while facing the first side 181*b*, and thus covers the container 181*a* formed by the first side 181*b* and the second sides 181*c*.

The cover 182 includes at least one holding unit 182*a* extending outward to be hold on the frame 112 (see FIG. 5B), and the holding unit 182*a* has fixing holes and a wire hole 182*b*.

The wire hole 182*b* functions as a passage through which wires connected to the PCB substrate 183 are drawn to the outside of the housing 181. The wires are connected to the driving module 190.

A sealing material 182*c* is filled in the wire hole 182*b* of the cover 182.

The sealing material 182*c* may be silicon, and acts to prevent air or water from permeating the housing 181 after the wires are drawn out through the wire hole 182*b*.

That is, by sealing up the container 181*a* of the housing 181 with the cover 182 and the sealing material 182*c*, water from the pad 163*b* of the cleaning tool assembly 160 is prevented from arriving at the first sensor 184, a second sensor 185, and the PCB substrate 183, and the second sensor 185 is prevented from contacting any other medium except for air in the container 181*a*.

Thereby, capacitance values measured by the first and second sensors 184 and 185 are prevented from varying depending on the temperature or humidity of external air.

The size of the housing 181 corresponds to the size of the inserting hole 113 (see FIG. 5A), and the size of the cover 182 is larger than the size of the inserting hole 113.

Accordingly, the first side 181*b* and the second sides 181*c* of the capacitance measurer 180 are inserted into the inserting hole 113 of the frame 112, and the cover 182 is hold on the frame 112.

The capacitance measurer 180 may further include the second sensor 185 for measuring capacitance of air in the container 181*a*, the air influenced by external environmental conditions, in order to determine a change of capacitance measured by the first sensor 184 according to external environmental conditions such as an external temperature or humidity.

As illustrated in FIG. 7B, the first and second sensors 184 and 185 are positioned on the PCB substrate 183 in such a manner that the first sensor 184 is disposed on the lower surface 183*a* of the PCB substrate 183 facing the first side 181*b* of the housing 181, and the second sensor 185 is disposed on the upper surface 183*b* of the housing 181 facing the cover 182 of the housing 181.

That is, the first and second sensors 184 and 185 are positioned on different sides of the PCB substrate 183, and measure capacitance values of different objects.

That is, the first sensor 184 disposed to contact the first side 181*b* of the housing 181 measures capacitance corresponding to an amount of water absorbed in the pad 163*b* of the cleaning tool assembly 160, and the second sensor 185 disposed to face the cover 182 of the housing 181 measures capacitance of air in the inner space of the container 181*a* of the housing 181, the capacitance of air corresponding to an environmental change such as a change in temperature, humidity, etc.

The environmental change in temperature, humidity, etc. in the container 181*a* of the housing 181 depends on external temperature, external humidity, etc.

The first sensor 184 is designed to be larger than the second sensor 185 in order for the first sensor 184 to sensitively measure capacitance with respect to water absorbed in the pad 163*b* of the cleaning tool assembly 160.

Therefore, the robot cleaner 100 (see FIG. 2) measures an amount of water absorbed in the pad 163*b* of the cleaning tool assembly 160, by compensating for a capacitance value measured by the first sensor 184 using a capacitance value measured by the second sensor 185 and changing according to changes in external temperature and external humidity, based on a characteristic that the capacitance values measured by the first and second sensors 184 and 185 change in the same manner according to an external environment.

The capacitance measurer 180 may further include a sealing member 186 disposed between the first side 181*b* of the housing 181 and the PCB substrate 183 in order to prevent an air gap from being formed between the first side 181*b* of the housing 181 and the PCB substrate 183.

The sealing member 186 fills up a thin air gap that may be formed between the first side 181*b* of the housing 181 and the PCB substrate 183, thereby preventing the first sensor 184 from contacting air.

The sealing member 186 may be adhesive such as a double-sided tape.

As another exemplary embodiment, the capacitance measurer 180 may further include a close-contacting member 187 for preventing an air gap from being formed between the first side 181*b* of the housing 181 and the PCB substrate 183.

The capacitance measurer 180 including the close-contacting member 187 will be described in detail with reference to FIG. 8, below.

Figure 8:
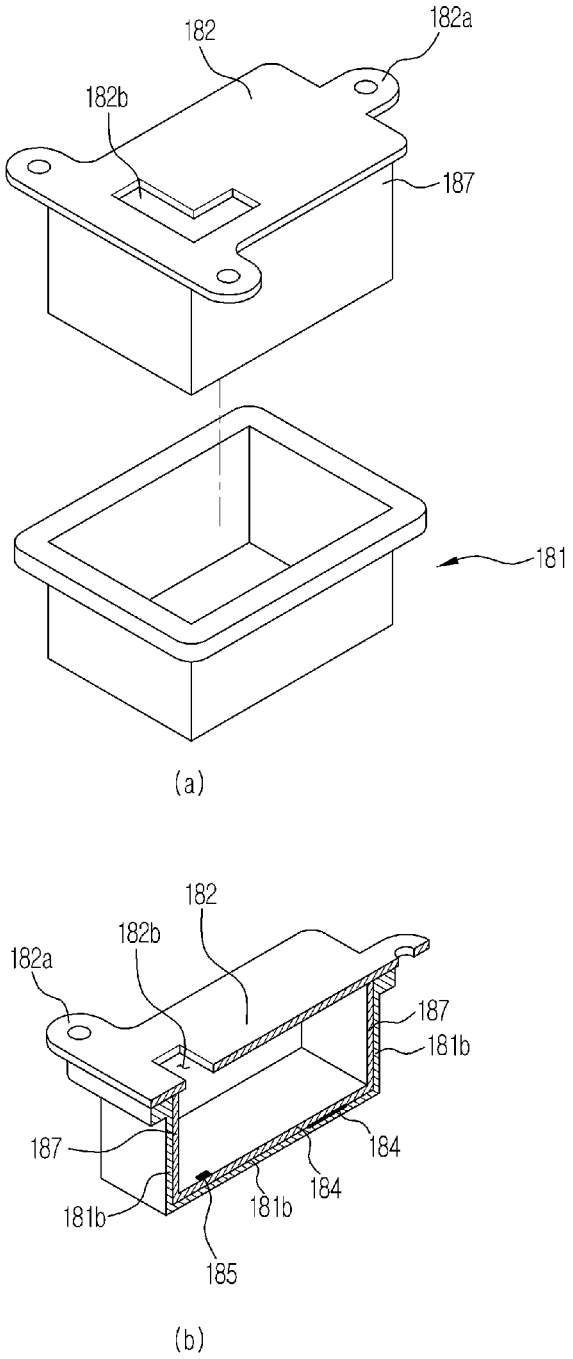
FIG. 8, (a) and (b), is an exploded perspective view and a cross-sectional view illustrating a housing and a cover of the capacitance measurer installed in the robot cleaner, according to an exemplary embodiment.

FIG. 8 is an exploded perspective view and a cross-sectional view illustrating a housing 181 and a cover 182 of a capacitance measurer 180 installed in the robot cleaner 100, according to an exemplary embodiment.

Referring to FIG. 8, the capacitance measurer 180 may include a housing 181 having an opening and a container 181, a cover 182 covering the opening of the housing 181, a PCB substrate 183 disposed in the container 181*a* of the housing 181, a first sensor 184 disposed on the PCB substrate 183 to measure capacitance in order to measure an amount of water of the cleaning tool assembly 160 (see FIG. 2), and a second sensor 185 for measuring capacitance of air in the inner space of the container 181*a*, the air influenced by external environmental conditions, in order to determine a change of capacitance measured by the first sensor 184 according to external environmental conditions such as an external temperature or humidity.

Likewise, the bottom of the housing 181 is referred to as a first side 181*b*, and the lateral sides of the housing 181 are referred to as second sides 181*c*, wherein the inner surface of the first side 181*b* contacts the PCB substrate 183 and the outer surface of the first side 181*b* contacts the cleaning tool assembly 160.

The cover 182 is disposed to contact the edges of the second sides 181*c* while facing the first side 181*b*, and covers the container 181*a* formed by the first side 181*b* and the second sides 181*c*.

The cover 182 includes at least one holding unit 182*a* extending outward to be hold on the frame 112 (see FIG. 5B), and the holding unit 182*a* has fixing holes and a wire hole 182*b*.

The capacitance measurer 180 further includes a close-contacting member 187 which is protruded from the lower surface of the cover 182, and the close-contacting member 187 is inserted into the container 181*a* of the housing 181 upon coupling with the housing 181. The close-contacting member 187 contacts the upper surface of the PCB substrate 182 to apply pressure to the upper surface of the PCB substrate 182, thereby causing the lower surface of the PCB substrate 182 to closely contact the first side 181*b* of the housing 181.

The close-contacting member 187 may be formed in a shape corresponding to the shape of the second sides 181*c* of the housing 181 so that the close-contacting member 187 contacts all the inner surfaces of the second sides 181*c* to apply pressure to all the edges of the PCB substrate 183, or the close-contacting member 187 may be formed in a bar shape so as to apply pressure to only a part of the PCB substrate 183.

The close-coupling member 187 may be made of an elastic material.

As such, by using the close-contacting member 187 to cause the first side 181*b* of the housing 181 to closely contact the PCB substrate 183, the first sensor 184 is prevented from contacting external air.

Also, by using the close-contacting member 187 to prevent an air gap from being formed between the first side 181*b* of the housing 181 and the PCB substrate 183, the first sensor 184 can sensitively measure capacitance of the cleaning tool assembly 160.

As another exemplary embodiment, the first side 181*b* of the capacitance measurer 180 may be formed in a shape corresponding to the shape of the pad 163*b* of the drum-type pad member 163-1 (see FIG. 4). The capacitance measurer 180 will be described in detail with reference to FIG. 9, below.

Figure 9:
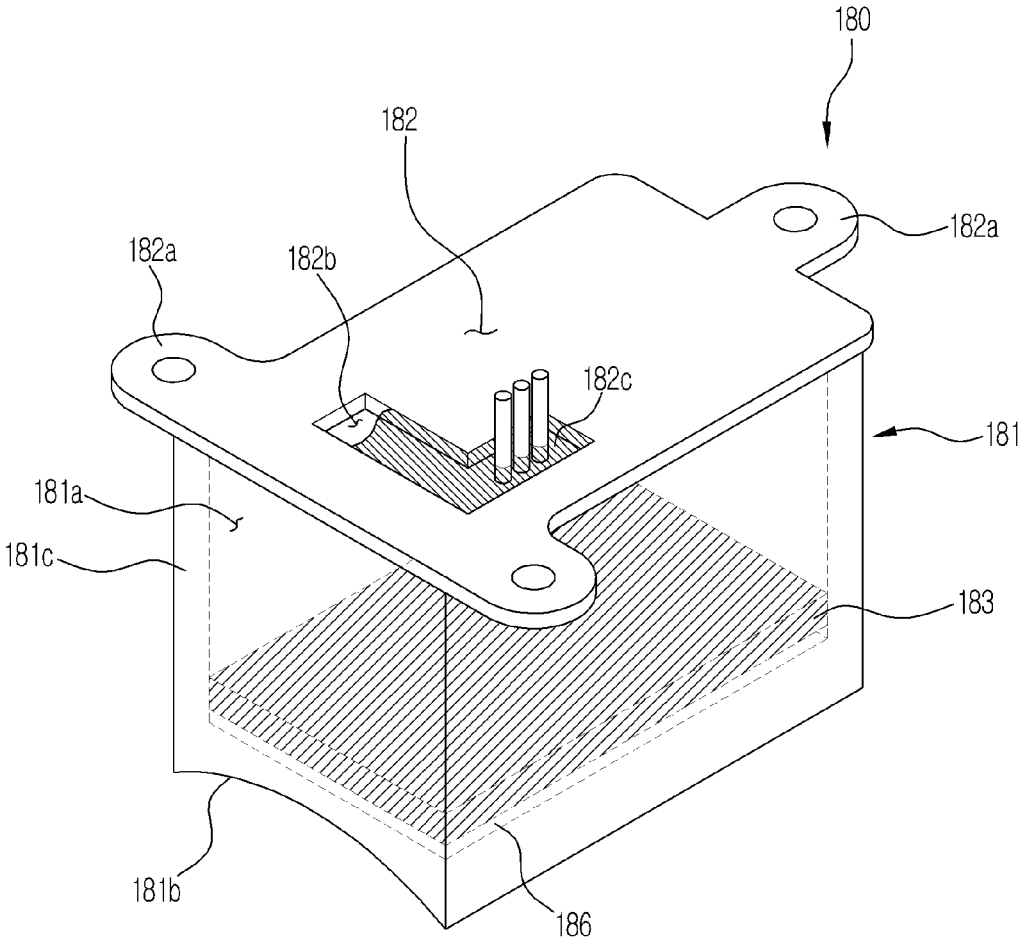
FIG. 9 is a perspective view of a capacitance measurer installed in a robot cleaner, according to an exemplary embodiment.

FIG. 9 is a perspective view illustrating a capacitance measurer 180 installed in the robot cleaner 100, according to an exemplary embodiment;

Referring to FIG. 9, the capacitance measurer 180 may include a housing 181 having an opening and a container 181, a cover 182 covering the opening of the housing 181, a PCB substrate 183 disposed in the container 181*a* of the housing 181, and first and second sensors 184 and 185 disposed on the lower and upper surfaces of the PCB substrate 183.

Likewise, the bottom of the housing 181 is referred to as a first side 181*b*, and the lateral sides of the housing 181 are referred to as second sides 181*c*, wherein the inner surface of the first side 181*b* contacts the PCB substrate 183 and the outer surface of the first side 161*b* contacts the cleaning tool assembly 160.

The inner surface of the first side 181*b* has a flat shape corresponding to the flat shape of the PCB substrate 183, and the outer surface of the first side 181*b* has a curved shape corresponding to the shape of the drum-type pad member 163-1 of the cleaning tool assembly 160 (see FIG. 4).

That is, the outer surface of the first side 181*b* of the housing 181 has a curvature corresponding to that of the drum-type pad member 163-1.

Due to the curved structure of the first side 181*b*, when the drum-type pad member 163-1 rotates with the first side 181*b* buried in the pad 163*b* of the drum-type pad member 163-1, a load applied to the drum-type pad member 163-1 can be reduced.

The capacitance measurer 180 will be described in more detail with reference to FIGS. 10A and 10B, below.

Figure 10A:
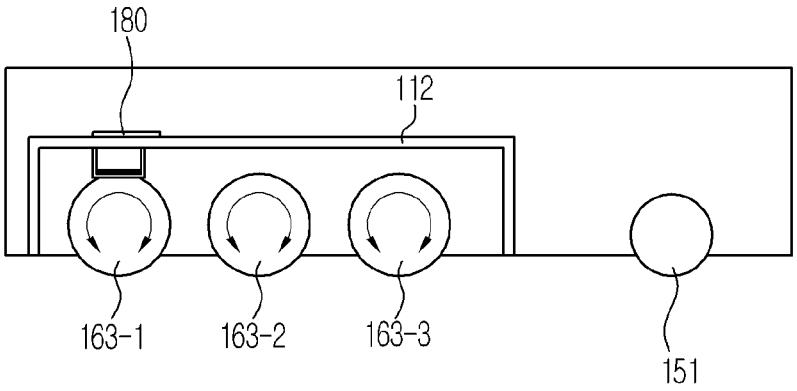
FIGS. 10A and 10B are cross-sectional views illustrating a state in which a capacitance measurer has been installed in a robot cleaner, according to an exemplary embodiment.
Figure 10B:
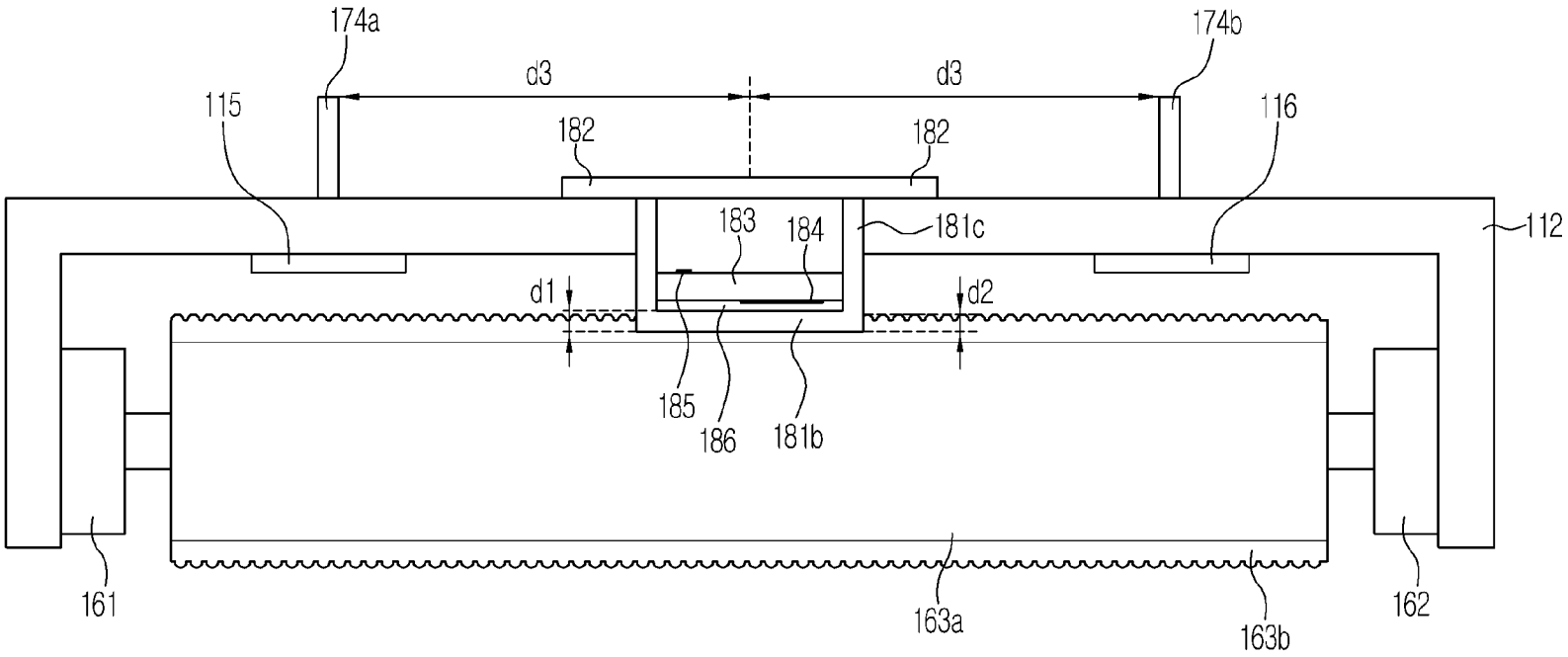

FIGS. 10A and 10B are cross-sectional views illustrating a state in which the capacitance measurer 180 has been installed in the robot cleaner 100, according to an exemplary embodiment.

Referring to FIGS. 10A and 10B, the housing 181 (see FIG. 9) of the capacitance measurer 180 is inserted into the inserting hole 113 (see FIG. 5A) of the frame 112 in the direction from top to bottom. Accordingly, the housing 181 of the capacitance measurer 180 is protruded from the frame 112 toward the cleaning tool assembly 160.

At this time, the cover 182 of the capacitance measurer 180 is hold on the frame 112, and the first side 181*b* of the housing 181 contacts the drum-type pad member 163-1 of the cleaning tool assembly 160.

Alternatively, the capacitance measurer 180 may be installed in the frame 112 through screw-coupling with the fixing holes of the setting unit 182*a* or through adhesive.

Referring to FIG. 10B, a first thickness d1 of the housing 181 of the capacitance measurer 180 has been decided in consideration of a change rate of a capacitance value with respect to an increased amount of water absorbed in the pad 163*b* of the cleaning tool assembly 160.

In more detail, when an amount of water absorbed in the pad 163*b* of the cleaning tool assembly 160 has increased by a predetermined amount, a change rate of a capacitance value measured by a capacitance measurer whose first side has a thickness of 1 mm is greater than a change rate of a capacitance value measured by a capacitance measurer whose first side has a thickness of 2 mm.

That is, when an amount of water absorbed in the pad 163*b* of the cleaning tool assembly 160 has increased by a predetermined amount, a change rate of a capacitance value measured by the first sensor 184 is greater as the thickness of the first side 181*b* of the housing 181 is thinner.

In other words, since a capacitance value measured by the first sensor 184 greatly changes in spite of a little change in an amount of water of the pad 163*b* when the first side 181*b* of the housing 181 has a thin thickness, the thin thickness of the first side 181*b* enables the first sensor 184 to accurately measure an amount of water absorbed in the pad 163*b*.

As such, by setting the first thickness d1 of the housing 181 in consideration of a change rate of capacitance with respect to a predetermined increased amount of water, it is possible to improve measurement accuracy for an amount of water of the cleaning tool assembly 160.

However, since there is limitation in reducing the thickness of the first side 181*b* of a capacitance measurer in view of a manufacturing process, the first side 181*b* is preferably set to a thickness ranging from about 0.5 mm to about 1.5 mm.

The first side 181*b* of the housing 181 contacts the PCB substrate 183.

The housing 181 of the capacitance measurer 180 protruded downward from the frame 112 is buried in the pad 163*b* of the cleaning tool assembly 160 by a second thickness d2 which is an overlapping thickness in order to improve measurement accuracy for an amount of water.

That is, the housing 181 of the capacitance measurer 180 is buried in the pad 163*b* of the cleaning tool assembly 160 by an overlapping thickness d2.

When an amount of water of the pad 163*b* of the cleaning tool assembly 160 has increased by a predetermined amount, a change rate of a capacitance value measured by the first sensor 184 is greater as an overlapping thickness d2 of the housing 181 and the pad 163*b* of the cleaning tool assembly 160 is thicker.

In other words, since a capacitance value measured by the first sensor 184 greatly changes in spite of the same change in an amount of water of the pad 163*b* as the overlapping thickness d2 of the housing 181 and the pad 163*b* is thicker, an appropriate overlapping thickness d2 enables the first sensor 184 to accurately measure an amount of water absorbed in the pad 163*b*.

The overlapping thickness d2 is set to an arbitrary thickness having no influence on rotation of the drum-type pad member 163-1 between a minimum overlapping thickness at which no air gap is formed between the pad 163*b* and the outer surface of the first side 181*b* and a maximum overlapping thickness corresponding to the thickness of the pad 163*b*.

That is, the overlapping thickness d2 may be appropriately set in consideration of a fact that a friction force between the housing 181 of the capacitance measurer 180 and the pad 163*b* increases in proportion to the overlapping thickness d2 of the housing 181 and the pad 163*b* to weaken a rotation force of the drum-type pad member 163-1.

As such, by setting an overlapping thickness d2 of the housing 181 of the capacitance measurer 180 and the pad 163*b* in consideration of a change rate of capacitance and a rotation speed of the drum-type pad member 163-1, it is possible to improve measurement accuracy for an amount of water of the cleaning tool assembly 160 while maintaining cleaning performance of the robot cleaner 100.

The capacitance measurer 180 is spaced by a third distance d3 from the first and second channels 174*a* and 174*b* of the channel member 174 for adding water to the pad 163*b* of the cleaning tool assembly 160.

The third distance d3 may be about 20 mm at which whether or not the pad 163*b* has been attached on the drum 163*a* (see FIG. 4) can be determined.

A capacitance value measured by the first sensor 184 when no pad is attached on the drum 163*a* is more or less the same as a capacitance value measured by the first sensor 184 when the pad 163*b* attached on the drum 163*a* is in a dry state.

Accordingly, in order to distinguish the case in which no pad is attached on the drum 163*a* from the case in which the pad 163*b* attached on the drum 163*a* is in a dry state, a distance for water-spreading is set such that different capacitance values are measured by the first sensor 184 when a small amount of water is supplied to the pad 163*b*.

Also, by arranging the first and second channels 174*a* and 174*b* to be symmetrical to each other with the capacitance measurer 180 in between, it is possible to supply a constant amount of water to the entire surface of the pad 163*d* of the cleaning tool assembly 160.

The first thickness d1 of the first side 181*b* of the housing 181, the overlapping thickness d2 of the housing 181 and the pad 163*b*, and the third distance d3 between the housing 181 and each channel 174*a* or 174*b* may be set to optimal values for accurately measuring an amount of water of the pad 163*b* based on capacitance, through a predetermined test.

The robot cleaner 100 may further include a pad detector (not shown) for determining whether a pad has been attached on the cleaning tool assembly 160. The pad detector may be implemented as an optical sensor or a micro switch that is disposed adjacent to the cleaning tool assembly 160.

Figure 11:
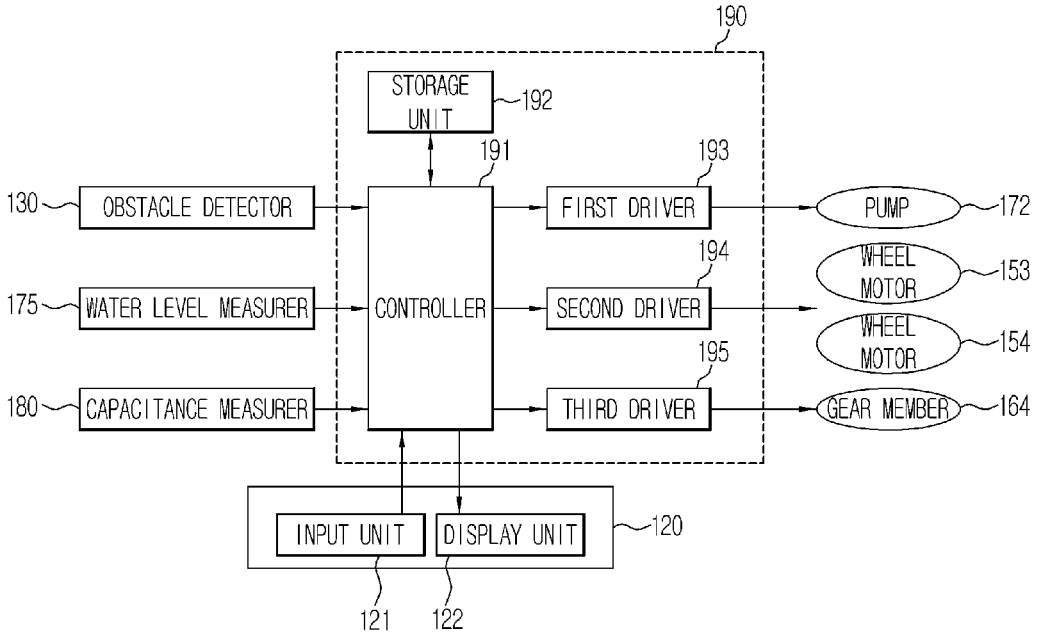
FIG. 11 is a block diagram illustrating a configuration for controlling a robot cleaner, according to an exemplary embodiment.

FIG. 11 is a block diagram illustrating a configuration for controlling the robot cleaner 100, according to an exemplary embodiment. Referring to FIG. 11, the robot cleaner 100 includes a user interface 120, an obstacle detector 130, a water level measurer 175, a capacitance measurer 180, and a driving module 190.

In more detail, the user interface 120 includes an input unit 121 for receiving schedule information, a cleaning start/end command, a driving mode, etc. and a display unit 122 for displaying schedule information, a battery level, a water level of a water tank, an amount of water of a pad, etc.

The driving mode includes a cleaning mode, a standby mode, a docking mode, etc.

The obstacle detectors 130 detects an obstacle existing in an area to be cleaned, and transmits an obstacle detection signal to a controller 191.

The obstacle detection signal output from the obstacle detector 130 may include a distance detection signal representing a distance to the obstacle.

The water level measurer 175 measures a level of water stored in the water tank 171 (see FIG. 6), and transfers information regarding the measured level of water to the controller 191. Also, the water level measurer 175 may measure an amount of water stored in the water tank 171.

The capacitance measurer 180 measures capacitance of the pad 163*b* of the cleaning tool assembly 160 (see FIG. 4), and transfers information regarding the measured capacitance to the controller 191 in order to measure an amount of water absorbed in the pad 163*b* of the cleaning tool assembly 160.

The capacitance measurer 180 may also measure capacitance of air in the inner space of the housing 181.

The capacitance measurer 180 may include a first sensor 184 for measuring capacitance of the pad 163*b*, and a second sensor 185 for measuring capacitance of air in the inner space of the housing 181 (see FIG. 8).

The first sensor 184 measures capacitance of the pad 163*b* based on a change in voltage, frequency, etc. of an alternating current signal, which changes depending on the state of the pad 163*b* and an amount of water of the pad 163*b*.

The second sensor 185 measures capacitance of air in the inner space of the housing 181 based on a change in voltage, frequency, etc. of an alternating current signal which changes depending on environmental conditions, such as temperature and humidity.

Hereinafter, a principle of measuring an amount of water absorbed in a pad based on capacitance will be described with reference to FIG. 12.

Figure 12:
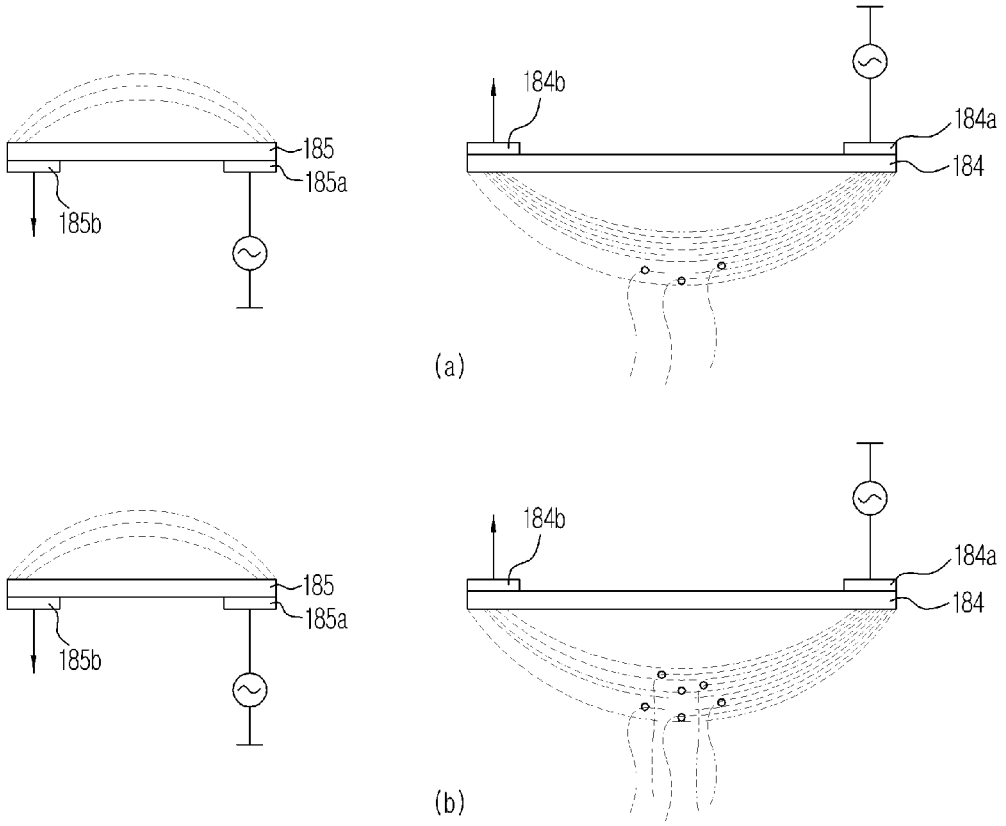
FIG. 12, (a) and (b), illustrates a method in which a capacitance measurer installed in a robot cleaner measures capacitance, according to an exemplary embodiment.

FIG. 12 illustrates a method in which the capacitance measurer 180 installed in the robot cleaner 100 measures capacitance, according to an exemplary embodiment.

The first sensor 184 includes a film on which charges are formed, a first electrode 184*a* which is disposed on the lower surface of the film and to which an alternating current voltage is applied, and a second electrode 184*b* which is disposed on the lower surface of the film and which detects a change of charges according to a change of an electric field formed on the film.

The change of charges on the film of the first sensor 184 changes a voltage or frequency.

This will be described as an example, below.

If a human hand contacts the film of the first sensor 184, charges formed on the film move through the human hand so that an alternating current frequency of the film is lowered than before the human hand contacts the film. That is, the human hand acts as a capacitor.

As such, the film of the first sensor 184 functions as a capacitor, and at this time, a small amount of charges moves to the surface of the pad 163*b*.

However, if the film of the first sensor 184 contacts the pad 163*b*, charges of the film move to the pad 163*b* to lower the frequency of the alternating current signal so that a capacitance value changes.

The more amount of water absorbed in the pad 163*b*, the more charges formed on the film move to the surface of the pad 163*b*. Accordingly, the frequency of an alternating current signal detected from the surface of the film is significantly lowered to increase a change of a capacitance value.

The second sensor 185 includes a film on which charges are formed, a first electrode 185*a* which is disposed on the film and to which an alternating current voltage is applied, and a second electrode 185*b* which is disposed on the film and which detects a change of charges according to a change of an electric field formed on the lower surface of the film The change of charges on the film of the second sensor 185 changes a voltage or frequency.

Also, charges formed on the surface of the second sensor 185 vary depending on the temperature and humidity of air in the inner space of the container 181*a* of the housing 181 (see FIG. 9).

The driving module 190 (see FIG. 11) drives loads, such as the pump 172 (see FIG. 6), the wheel motors 153 and 154 (see FIG. 2), and the gear member 164 (see FIG. 5A), based on signals transmitted from the user interface 120 (see FIG. 11), the obstacle detector 130, the water level measurer 175, and the capacitance measurer 180 (see FIG. 11).

The driving module 190 includes a controller 191, a storage unit 192, and a plurality of drivers 193, 194, and 195 (see FIG. 11).

The controller 191 controls collision-avoidance traveling based on an obstacle detection signal detected by the obstacle detector 130.

The controller 191 compares a water level of the water tank 171 (see FIG. 6), measured by the water level measurer 175, to a reference water level, and controls driving of the display unit 122 to display information indicating a lack of water on the display unit 122, if the measured water level of the water tank 171 is lower than the reference water level.

If a cleaning command is received, the controller 191 determines whether a pad has been attached on the cleaning tool assembly 160 (see FIG. 2). If no pad has been attached on a drum, the controller 191 controls driving of the display unit 122 to display information notifying that no pad is attached on a drum on the display unit 122, and if a pad has been attached on the drum, the controller 191 controls driving of the wheel motors 153 and 154 and the gear member 164 so that the robot cleaner 100 travels and cleans.

The controller 191 measures an amount of water of the pad 163*b* of the cleaning tool assembly 160 based on capacitance measured by the capacitance measurer 180 during traveling and cleaning, compares the measured amount of water to a first reference amount of water, controls the pump 172 to add water to the pad 163 if the measured amount of water is less than the first reference amount of water, and continues to clean if the measured amount of water is more than the first reference amount of water.

The first reference amount of water is an amount of water corresponding to a driving mode set through the input unit 121 of the user interface 120, and is an amount of water for optimally performing the driving mode.

If an amount of water of the pad 163*b* is less than a second reference amount of water when a water level of the water tank 171 is lower than a reference water level, the controller 191 stops driving the wheel motors 153 and 154 and the gear member 164 to thus stop cleaning and traveling, and if the measured amount of water is more than the second reference amount of water, the controller 191 continues to clean.

Also, the controller 191 compensates for capacitance measured by the first sensor 184 based on capacitance measured by the second sensor 185 when measuring an amount of water, and measures an amount of water of the pad 163*b* based on the compensated capacitance.

The controller 191 controls water supply at regular time intervals such that the pad 163*b* is maintained with the first reference amount of water corresponding to a driving mode during traveling and cleaning, and controls driving of the gear member 164 such that the drum-type pad member 163-1 (see FIG. 2) rotates at a predetermined rotation speed.

If it is determined that cleaning has been completed, the controller 191 controls drying of the cleaning tool assembly 160 and docking with a recharging base.

In order to dry the cleaning tool assembly 160, the controller 191 may control driving of the gear member 164 in order for the drum 163*a* to rotate for a predetermined time period, thereby drying the pad 163*b* through friction of the pad 163*b* against a floor surface.

As another example, the controller 191 may control rotation of the wheel motors 153 and 154 in order for the main body 110 (see FIG. 1) to move back and forth for a predetermined time period, thereby drying the pad 163*b* through back-and-forth traveling.

As still another example, the controller 191 may control driving of the wheel motors 153 and 154 such that the main body 110 moves to a support of the recharging base and the frame of the main body 110 is held in the support, thereby drying the pad 163*b* with natural wind.

The storage unit 192 stores information regarding an amount of water of the pad 163*b* corresponding to the capacitance measured by the first sensor 184, and also stores a compensated value of the capacitance measured by the first sensor 184, corresponding to the capacitance measured by the second sensor 185.

The storage unit 192 stores information regarding the first reference amount of water for optimal cleaning and the second reference amount of water for determining a lack of water of the pad 163*b*, and also stores information regarding the reference water level for determining a lack of water of the water tank 171. The first reference amount of water may be set according to a driving mode selected by a user.

Also, the storage unit 192 stores information regarding an optimal amount of water for each driving mode, and information regarding a rotation speed of the drum 163*a* and a water adding period for an amount of water of the pad 163*b*.

The first driving unit 193 (see FIG. 11) drives the pump 172 (see FIG. 6) according to a command from the controller 191 to supply water stored in the water tank 171 to the pad 163*b*.

The second driver 194 (see FIG. 11) drives the wheel motors 153 and 154 according to a command from the controller 191 to move the main body 110 forward or backward or to rotate the main body 110.

The third driver 195 (see FIG. 11) drives the gear member 164 according to a command from the controller 191 to rotate the drum-type pad members 163-1, 163-2, and 163-3.

Figure 13:
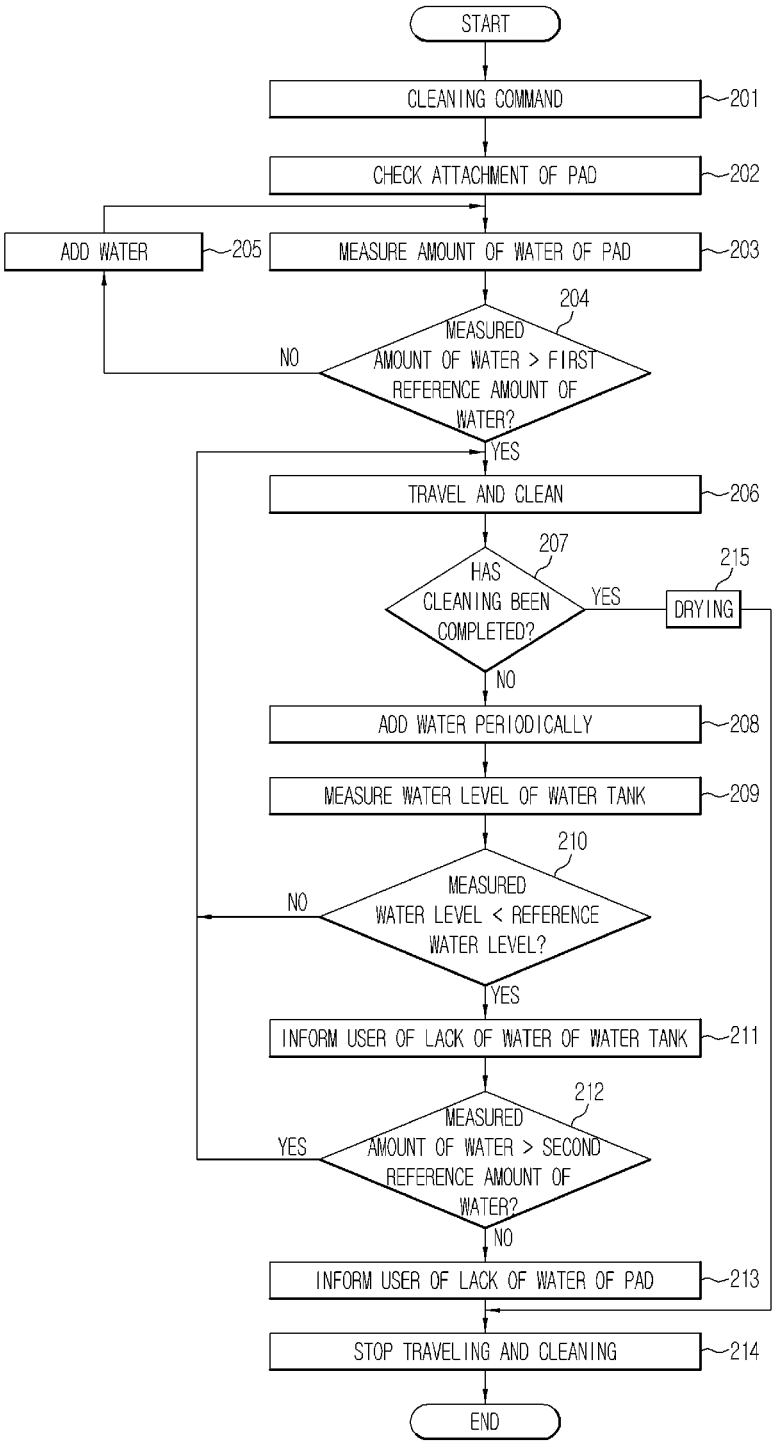
FIG. 13 is a flowchart illustrating a method of controlling a robot cleaner, according to an exemplary embodiment.

FIG. 13 is a flowchart illustrating a method of controlling the robot cleaner 100, according to an exemplary embodiment.

When a cleaning command is received through the input unit 121 (see FIG. 11) or when the system clock reaches a scheduled time (201), the robot cleaner 100 determines whether a pad has been attached on the cleaning tool assembly 160 (202).

At this time, the robot cleaner 100 first measures capacitance using the first sensor 184 (see FIG. 8) of the capacitance measurer 180 (see FIG. 7A), drives the pump 172 (see FIG. 11) to supply a predetermined amount of water to the cleaning tool assembly 160 through the first and second channels 174*a* and 174*b* (FIG. 3B), secondarily measures capacitance using the first sensor 184 after the predetermined amount of water has been supplied, and compares the first measured capacitance to the secondarily measured capacitance to determine whether the secondarily measured capacitance is different from the first measured capacitance, thereby determining whether a pad has been attached on the cleaning tool assembly 160.

That is, the robot cleaner 100 determines whether a capacitance value of the cleaning tool assembly 160 increases as an amount of water absorbed in the pad 163*b* of the cleaning tool assembly 160 increases, thereby determining whether a pad has been attached on the cleaning tool assembly 160.

If the secondarily measured capacitance is the same as the first measured capacitance, the robot cleaner 100 determines that the supplied water has been discharged to the outside to thus determine whether no pad is attached on the cleaning tool assembly 160, and outputs information indicating that no pad is attached on the cleaning tool assembly 160 on the display unit 122 (see FIG. 11) to inform a user. Alternatively, the robot cleaner 100 may inform a user of information indicating that no pad is attached on the cleaning tool assembly 160 through sound.

If it is determined that a pad has been attached on the cleaning tool assembly 160, the robot cleaner 100 measures an amount of water absorbed in the pad 163*b* based on the secondarily measured capacitance value.

The robot cleaner 100 may measure capacitance of the pad 163*b* while rotating the drum-type pad member 163-1. For example, the robot cleaner 100 may measure capacitance of at least one part of the pad 163*b* attached on the circumference surface of the drum 163*a* while rotating the drum 163*a* at a speed of 3 rpm, thereby determining an amount of water of the pad 163*b*.

The robot cleaner 100 may measure an amount of water of the pad 163*b* based on capacitance measured by the capacitance measurer 180 (203), and compares the measured amount of water to a first reference amount of water (for example, 30 g) (204).

If the measured amount of water is less than the first reference amount of water, the robot cleaner 100 controls the pump 172 to add water to the pad 163*b* (205), and if the measured amount of water is more than the first reference amount of water, the robot cleaner 100 performs traveling and cleaning.

The robot cleaner 100 may add water to the pad 163*b* for a predetermined time period every first water-adding time period. When adding water to the pad 163*b*, the robot cleaner 100 may rotate the drum-type pad member 163-1 at a first rotation speed.

Whenever adding water to the pad 163*b* every first water-adding time period, the robot cleaner 100 measures capacitance of the pad 163*b* if the predetermined time period has elapsed, calculates an amount of water corresponding to the measured capacitance, compares the calculated amount of water to a first reference amount of water to determine whether an amount of water absorbed in the pad 163*b* is equal to the first reference amount of water, thereby determining whether to stop adding water.

If it is determined that adding water has been completed, that is, if it is determined that an amount of water absorbed in the pad 163*b* is equal to the first reference amount of water, the robot cleaner 100 travels and cleans (206).

The first reference amount of water is an amount of water corresponding to a driving mode selected through the input unit 121 of the user interface 120, and is an amount of water for optimally performing the driving mode.

Then, the robot cleaner 100 travels and cleans a floor while controlling driving of the wheel motors 153 and 154 and the gear member 164, detects an obstacle, e.g., furniture, office supplies, walls, etc. existing on the floor and determines a distance to the obstacle based on an obstacle detection signal detected by the obstacle detector 130 (see FIG. 11), drives the wheels 151 and 152 (see FIG. 2) based on the distance to the obstacle to clean the floor with water while autonomously changing a traveling direction.

Then, the robot cleaner 100 determine whether cleaning has been completed during traveling and cleaning (207), and if cleaning has not yet been completed, the robot cleaner 100 continues to travel about and clean the floor adds water periodically (208).

During traveling and cleaning, the robot cleaner 100 adds water to the pad 163*b* every second water-adding time period (for example) to adjust an amount of water absorbed in the pad 163*b* to the first reference amount of water, and wipes the floor through friction with the floor while rotating the drum-type pad member 163-1 at a second rotation speed.

The second water-adding time period is longer than the first water-adding time period, and the second rotation speed is lower than the first rotation speed.

The reason why the second water-adding time period is set to be longer than the first water-adding time period and the second rotation speed is set to be lower than the first rotation speed is to make the pad 163*b* quickly absorb water.

Also, the second water-adding time period and the second rotation speed vary depending on the first reference amount of water. That is, as the first reference amount of water increases, the second water-adding time period becomes longer and the second rotation speed becomes higher.

The first drum-type pad member 163-1 wipes the floor with the pad 163*b* having a predetermined amount of water, and the second and third drum-type pad members 163-2 and 163-3 wipe the floor with dry pads. Accordingly, the second and third drum-type pad members 163-2 and 163-3 wipe off water remaining on the floor when the first drum-type pad member 163-1 has passed through the floor.

That is, the robot cleaner 100 wipes off foreign substances such as dust scattered on an area to be cleaned with water while autonomously traveling about the area.

In addition, a drum rotation speed and a time period at which water is added to the pad 163*b* may be adjusted according to an amount of water of the pad 163*b*.

For example, if an amount of water of the pad 163*b* is less than the first reference amount of water, that is, if there is a lack of water of the pad 163*b*, the robot cleaner 100 adds water to the pad 163*b* for about 10 minutes at time intervals of about 15 seconds while rotating the drum 163*a* at a rotation speed of 3 rpm, thereby uniformly and quickly adding water to the pad 163*b*.

Thereafter, if an amount of water of the pad 163*b* becomes equal to or more than the first reference amount of water, the robot cleaner 100 may lower the rotation speed of the drum 163*a* and lengthen a water-adding time period. For example, if about 10 minutes has elapsed from when the drum 163*a* has first rotated, the robot cleaner 100 may adjust the rotation speed of the drum 163*a* to 0.01 rpm, and add water to the pad 163*b* every 60 seconds while slowly rotating the drum 163*a*.

Also, if it is determined that an amount of water of the pad 163*b* is equal to the first reference amount of water, the robot cleaner 100 may adjust the rotation speed of the drum 163*a* to 0.01 rpm, and add water to the pad 163*a* every 60 seconds so as to slowly supply water to the pad 163*b* as long as the pad 163*b* is not dried.

Also, the robot cleaner 100 may perform cleaning while controlling a rotation speed of the drum 163*a* and a water-adding time period after once measuring an amount of water of the pad 163*b*, or may measure an amount of water of the pad 163*b* periodically or in real time during traveling, and automatically change a water-adding time period and a rotation speed of the drum 163*a* if the measured amount of water of the pad 163*b* is less than the first reference amount of water.

Also, the robot cleaner 100 measures a water level of the water tank 171 using the water level measurer 175 (see FIG. 11) during traveling and cleaning (209), compares the measured water level of the water tank 171 to a reference water level (210), and displays information representing a lack of water of the water tank 171 through the display unit 122 (see FIG. 11) if the measured water level of the water tank 171 is lower than the reference water level, thereby informing a user of a lack of water of the water tank 171 (211).

If the measured water level is higher than the reference water level, the robot cleaner 100 continues to travel and clean.

Also, when the water level of the water tank 171 is lower than the reference water level, the robot cleaner 100 calculates an amount of water corresponding to capacitance measured by the capacitance measurer 180, and compares the calculated amount of water to a second reference amount of water (212). If the calculated amount of water is more than the second reference amount of water, the robot cleaner 100 continues to travel and clean, and if the calculated amount of water is less than the second reference amount of water, the robot cleaner 100 displays information representing a lack of water of the pad 163*b* through the display unit 122 to thereby inform a user of a lack of water of the pad 163*b* (213), and stops driving the wheel motors 153 and 154 and the gear member 164 to stop traveling and cleaning (214).

Also, when calculating an amount of water of the pad 163*b*, the robot cleaner 100 may compensate for capacitance measured by the first sensor 184 using capacitance measured by the second sensor 185, and calculate an amount of water of the pad 163*b* based on the compensated capacitance.

If it is determined that cleaning has been completed, the robot cleaner 100 controls drying of the cleaning tool assembly 160 and docking with a recharging base.

In order to dry the cleaning tool assembly 160, the controller 191 may control driving of the gear member 164 in order for the drum 163*a* to rotate for a predetermined time period, thereby drying the pad 163*b* through friction of the pad 163*b* against a floor surface.

As another example, the controller 191 may control rotation of the wheel motors 153 and 154 in order for the main body 110 (see FIG. 1) to move back and forth for a predetermined time period, thereby drying the pad 163*b* through back-and-forth traveling.

As still another example, the controller 191 may control driving of the wheel motors 153 and 154 such that the main body 110 moves to a support (not shown) of a recharging base (not shown) and the frame of the main body 110 is held in the support, thereby drying the pad 163*b* with natural wind.

In this way, by drying the pad 163*b* until an amount of water of the pad 163*b* is less than a predetermined amount of water, it is possible to prevent the pad 163*b* from having a bad smell.

Also, the robot cleaner 100 docks with the recharging base if cleaning has been completed or if a battery level is lower than a reference level, and if docking has been completed, the robot cleaner 100 receives power from the recharging base to be charged.

Also, since the robot cleaner 100 includes the water tank 171 capable of continuing to supply water to the pad 163*b* during cleaning, efficiency of wet cleaning can be further improved.

Although a few embodiments have been shown and described, it would be appreciated by those skilled in the art that changes may be made in these embodiments without departing from the principles and spirit of the disclosure, the scope of which is defined in the claims and their equivalents.

What is claimed is:

1. A robot cleaner comprising:

a cleaning tool assembly to clean a floor with water to be provided to the cleaning tool assembly, the cleaning tool assembly including a pad configured to receive the water and to contact the floor;

a capacitance measurer installed in the cleaning tool assembly to contact the pad of the cleaning tool assembly and configured to measure capacitance of the pad; and a controller configured to calculate an amount of water remaining in the pad based on the measured capacitance, and to control a cleaning operation of the cleaning tool assembly based on the calculated amount of remaining water, the capacitance measurer overlapping with the pad of the cleaning tool assembly by a predetermined thickness which is an overlapping thickness.

2. The robot cleaner according to claim 1, wherein the cleaning tool assembly comprises a drum removably coupled to a main body, a drum-type pad member having the pad removably attached on the drum, and a gear member which rotates the drum-type pad member, wherein the capacitance measurer is installed in the main body.

3. The robot cleaner according to claim 2, further comprising a water-feeder which supplies water to the cleaning tool assembly, wherein the controller is configured to control the water-feeder based on the amount of water remaining in the cleaning tool assembly to supply water to the cleaning tool assembly during cleaning.

4. The robot cleaner according to claim 2, further comprising:

a user interface to receive a user's selection for a driving mode, and to output driving information; and a water-feeder to supply water to the cleaning tool assembly, wherein the controller is configured to check a first reference amount of water of the cleaning tool assembly corresponding to the driving mode, and to control a second water-feeding time period of the water-feeder based on the first reference amount of water during cleaning.

5. The robot cleaner according to claim 4, wherein the controller is configured to compare the amount of water remaining in the cleaning tool assembly to a second reference amount of water, and to stop cleaning if the amount of water remaining in the cleaning tool assembly is less than the second reference amount of water.

6. The robot cleaner according to claim 4, wherein the controller is configured to control revolutions per minute (rpm) of the drum-type pad member based on the first reference amount of water.

7. The robot cleaner according to claim 4, wherein:

the water-feeder comprises a water tank to store water, a pump to pump water stored in the water tank, a channel member to guide the pumped water to the drum-type pad member of the cleaning tool assembly, and a water level measurer to measure a water level of the water tank, and the controller is configured to compare the measured water level to a reference water level, and to control the user interface to output information representing a lack of water in the water tank if the measured water level is lower than the reference water level.

8. The robot cleaner according to claim 1, wherein the controller is configured to determine whether cleaning has been completed, and to control a drying mode if the cleaning has been completed.

9. The robot cleaner according to claim 8, wherein the controller is configured to control rotation of the cleaning tool assembly for a predetermined time period in the drying mode.

10. The robot cleaner according to claim 8, further comprising a main body and a traveling assembly to move the main body, wherein the controller is configured to control the traveling assembly in the drying mode such that the main body moves back and forth.

11. The robot cleaner according to claim 1, wherein the capacitance measurer comprises:

a housing;

a Printed Circuit Board (PCB) substrate disposed in the housing;

a first sensor which is disposed on a first surface of the PCB substrate toward the pad, and which measures the capacitance; and a second sensor which is disposed on a second surface of the PCB substrate, the second surface being opposite to the first surface of the PCB substrate on which the first sensor is disposed, the second sensor not contacting the pad and measuring a reference capacitance, and the controller compensates the capacitance measured by the first sensor using the reference capacitance measured by the second sensor when calculating the amount of water remaining in the cleaning tool assembly.

* * * * *